United States Patent [19]

Lenosky

[11] Patent Number: 4,477,932

[45] Date of Patent: Oct. 23, 1984

[54] RAISED SUPERIMPOSED TOILET SEAT AND SECURING CLAMP

[75] Inventor: Theodore Lenosky, Fairfield, N.J.

[73] Assignee: Maddak, Inc., Pequannock, N.J.

[21] Appl. No.: 578,849

[22] Filed: Feb. 10, 1984

[51] Int. Cl.[3] ..... A47K 13/06; A47K 13/12

[52] U.S. Cl. ..... 4/239; 4/234; 4/237; 4/661

[58] Field of Search ..... 4/239, 661, 240, 237, 4/236, 234, 254; 297/253

[56] References Cited

U.S. PATENT DOCUMENTS

| | | | |
|---|---|---|---|
| 2,732,566 | 1/1956 | Bruelheide | 4/239 |
| 3,364,505 | 1/1968 | Palmier | 4/239 |
| 4,213,211 | 7/1980 | Bemis et al. | 4/239 |
| 4,214,323 | 7/1980 | Thomas | 4/239 X |

*Primary Examiner*—Henry K. Artis

*Attorney, Agent, or Firm*—Anthony F. Cuoco

[57] ABSTRACT

A raised toilet seal is superimposed upon the bowl of a conventional toilet. A clamp has a section which fits into a space provided when the lid and the seat of the conventional toilet are lifted and has another section which engages the back of the raised superimposed toilet seat, whereby the raised superimposed toilet seat is secured to the conventional toilet.

9 Claims, 11 Drawing Figures

RAISED SUPERIMPOSED TOILET SEAT AND SECURING CLAMP

BACKGROUND OF THE INVENTION

Raised toilet seats which are superimposed upon conventional toilets are an indispensable aid for invalids and others who experience difficulty in sitting on and raising from a conventional toilet seat. The raised superimposed toilet seat is disposed directly on the bowl of the conventional toilet and offers complete comfort to the user as is described. Toilet seats of the type contemplated are described, for example, in U.S. Pat. No. Des. 237,887 and U.S. Pat. No. Des. 242,457 issued to Kurt Landsberger on Dec. 2, 1975 and Nov. 23, 1976, respectively.

Prior to the present invention these seats have been used with conventional toilets as aforenoted without any clamping device to securely mount the seats to the conventional toilets. While this arrangement is sufficient in many situations, it is often required, to accommodate the capabilities of the user, to clamp the raised superimposed seat to the conventional toilet to secure the seat thereto and to otherwise provide a degree of stability to the seat when it is being used. The invention disclosed in copending commonly assigned U.S. patent application Ser. No. 554,785 filed on Nov. 23, 1983 by John Broeils describes one type of clamping arrangement for this purpose. The present invention describes another simpler and more versatile type of clamping arrangement.

SUMMARY OF THE INVENTION

This invention contemplates a raised toilet seat which is superimposed upon the bowl of a conventional toilet, with the lid and the seat of the conventional toilet in a lifted position, whereby a space is provided between the lifted seat and lid and the section of the toilet connecting the bowl and water tank of the toilet. In one embodiment of the invention a clamp has a section which fits into the space so as to be retained therein. In another embodiment of the invention the section of the clamp which fits into the space engages bolts which couple the lifted seat and lid to the connecting section. The back of the raised superimposed toilet seat carries a rail and the clamp carries a track which engages the rail and secures the clamp to the seat. The cooperative action of the clamp with the raised superimposed seat and the conventional toilet is effective for securing said seat to said conventional toilet.

DETAILED DESCRIPTION OF THE INVENTION

Figure 3:
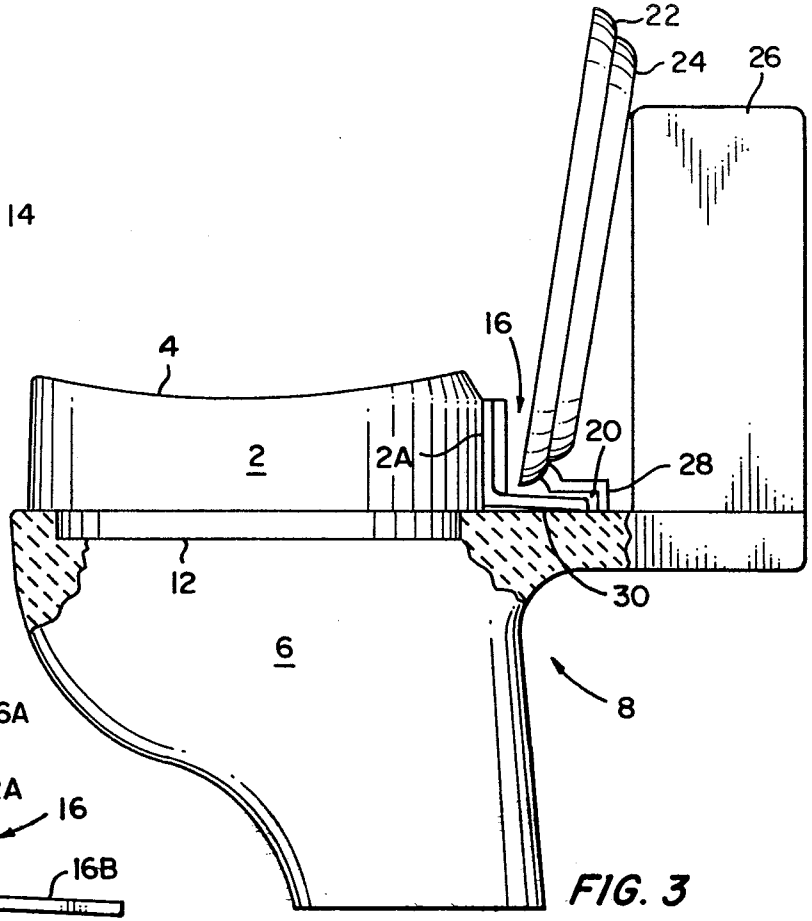
FIG. 3 is a diagrammatic, partially sectioned side view of the raised toilet seat shown in FIGS. 1 and 2 superimposed on a conventional toilet bowl, and generally showing the clamp arrangement according to the invention, whereby the raised superimposed seat is secured to the conventional toilet.
Figure 1:
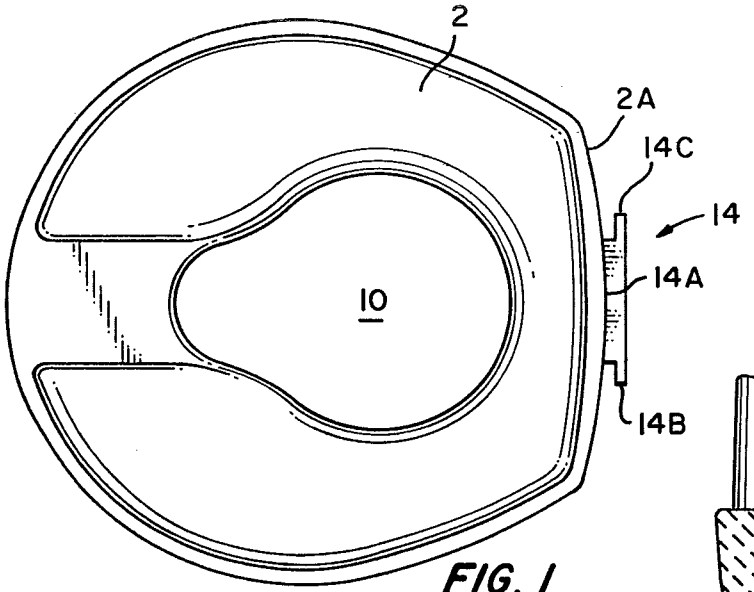
FIG. 1 is a diagrammatic top view of a raised toilet seat showing a rail carried on the back end thereof in accordance with the invention.
Figure 2:
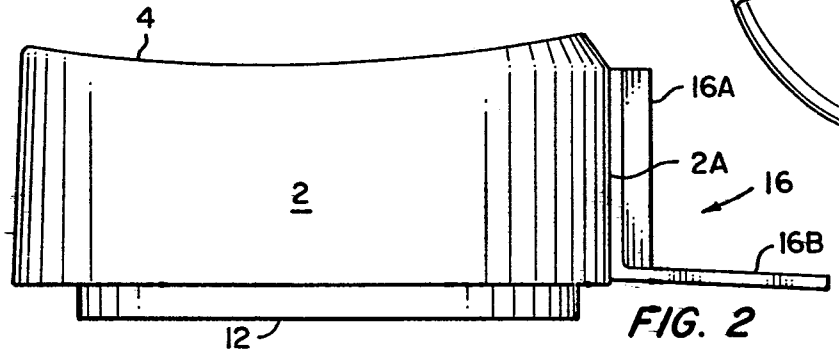
FIG. 2 is a diagrammatic side view of the toilet seat, the top view of which is shown in FIG. 1, and generally showing a clamp mounted to the back end of the toilet seat in accordance with the invention.

With reference to FIGS. 1, 2 and 3, a raised toilet seat is designated generally by the numeral 2. Raised toilet seat 2 may be of various configurations such as described in the aforenoted design U.S. Pat. No. Des. D237,887 and U.S. Pat. No. Des. D242,457 and is shown in FIGS. 1, 2 and 3 in its simplist form for purposes of describing the invention. It will therefore suffice to say that the top 4 of raised toilet seat 2 is suitably contoured and rests on a bowl 6 of a conventional toilet 8. Seat 2 has a through opening 10 disposed substantially central to the seat as best shown in FIG. 1.

Seat 2 has a lower portion 12 which is smaller in diameter than top 4 of the seat so as to fit within toilet bowl 6 of conventional toilet 8 (FIGS. 2 and 3). In modifying seat 2 for purposes of the present invention, the back end 2A of the seat carries a rail designated generally by the numeral 14 in FIG. 1. Rail 14 extends substantially vertically and is engaged by a clamp 16 shown in FIGS. 2 and 3 as will be hereinafter described with reference to FIGS. 4 and 5.

With specific reference to FIG. 3, seat 2 is superimposed upon bowl 6 until lower portion 12 of seat 2 rests within the bowl. Clamp 16 engages rail 14 and is disposed within a space 20. Space 20 is provided when a seat 22 and a lid 24 of conventional toilet 8 are in a lifted position so as to rest against a water tank 26. Space 20 ia provided between a conventional coupling arrangement 28 and a bowl and tank connecting section 30. Coupling arrangement 28 is symbolically shown in FIG. 3 and enables seat 24 and lid 22 to be raised and lowered relative to toilet bowl 6.

Clamp 16, in association with rail 14 and space 20, is shown generally in FIG. 3 and will be more specifically described with reference to FIGS. 4 and 5 and FIGS. 6–8 and 9–11. Only as much of conventional toilet 8 is shown and described as is necessary to understand the present invention.

With reference again to FIG. 1, rail 14 is seen as having a base 14A which is integral with the back end 2A of seat 2 and a pair of arms 14B and 14C extending in opposite directions beyond base 14A. In this connection it is noted that rail 14 may be molded integral with seat 2, both of which may be of a suitable polyethylene material to serve the intended purposes of the invention.

Figure 6:
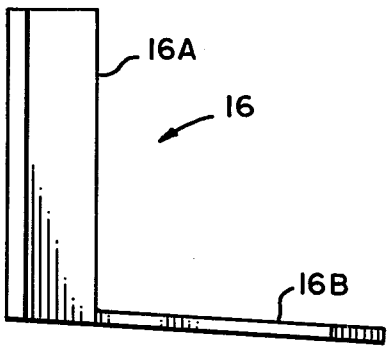
FIG. 6 is a diagrammatic side view of the clamp shown in the arrangement of FIG. 4.
Figure 7:
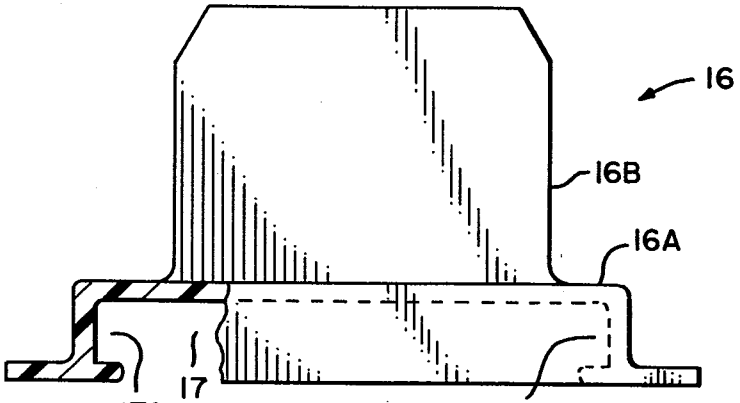
FIG. 7 is a partially sectioned diagrammatic top view of the clamp shown in FIG. 4.
Figure 8:
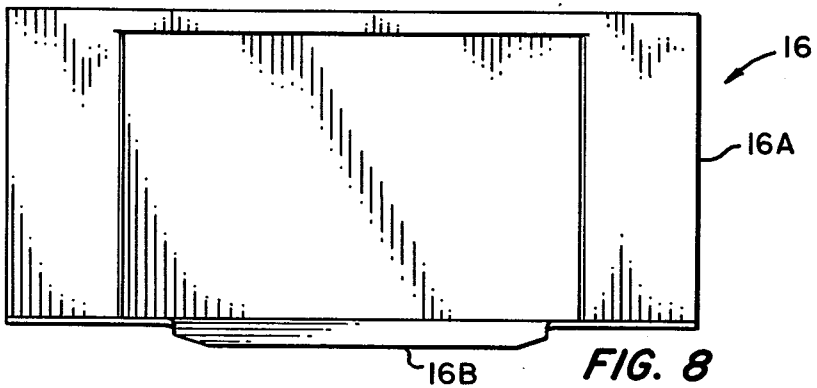
FIG. 8 is a diagrammatic rear view of the clamp shown in FIG. 4.

With reference now to FIGS. 6, 7 and 8, clamp 16, shown in one of its forms, is seen to have a section 16A and a section 16B. When clamp 16 is oriented for the purposes of the invention, section 16A is substantially vertical. Section 16B extends rearwardly therefrom and downwardly at a slight angle from the perpendicular. Section 16A carries a track 17 which has opposite end recesses 17A and 17B.

Figure 4:
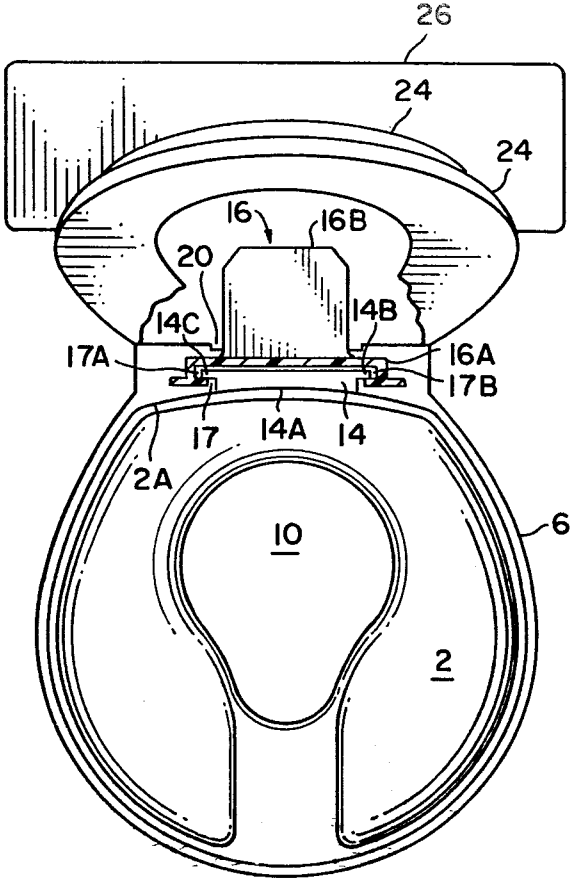
FIG. 4 is a diagrammatic top view, with respect to FIG. 3, and showing one form of the clamp arrangement generally shown in said FIG. 3.

With reference now to FIG. 4, clamp 16 as shown in FIGS. 6, 7 and 8 is disposed so that section 16B fits into space 20 and is captured therein. Rail 14 engages track 17 in sliding fit relation, with rail ends 14B and 14C captured within track recesses 17B and 17A, respectively. With the arrangement thus shown, clamp 16 in cooperation with rail 14 and with space 20 is effective for securely clamping raised toilet seat 2 in a superimposed position over toilet bowl 6 of toilet 8.

Figure 5:
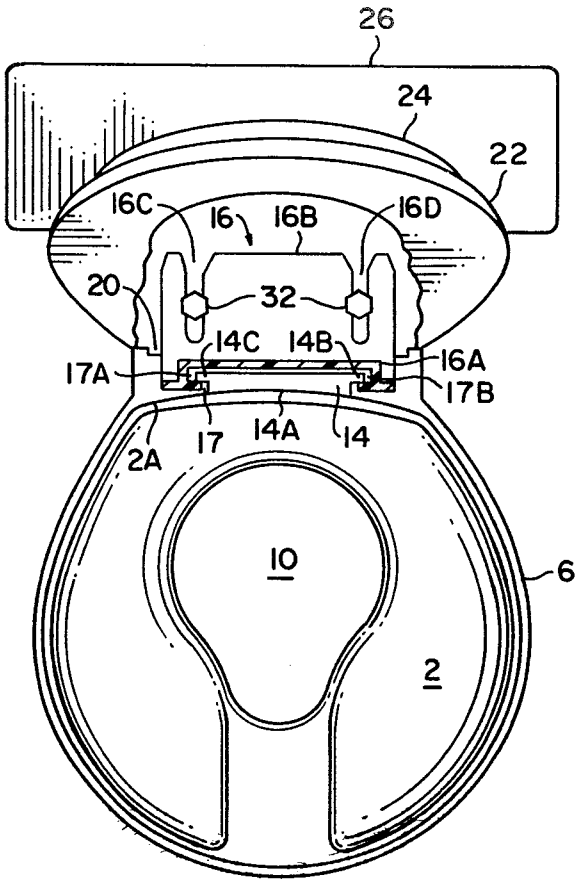
FIG. 5 is a diagrammatic top view, with respect to FIG. 3, and showing another form of the clamp arrangement generally shown in said FIG. 3.
Figure 9:
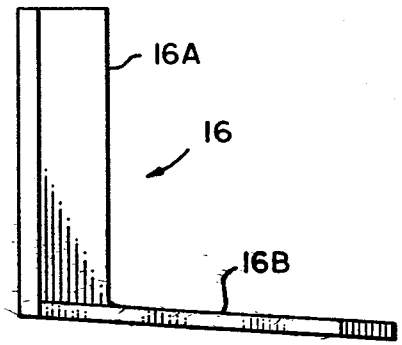
FIG. 9 is a diagrammatic side view of the clamp shown in the arrangement of FIG. 5.
Figure 10:
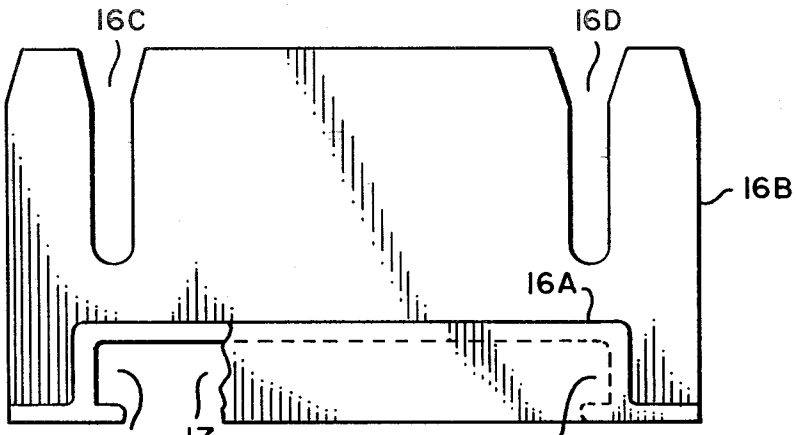
FIG. 10 is a partially sectioned diagrammatic top view of the clamp shown in FIG. 5.
Figure 11:
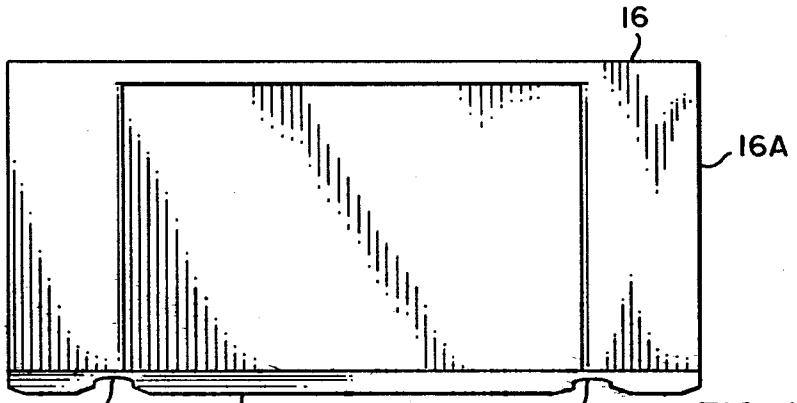
FIG. 11 is a diagrammatic rear view of the clamp shown in FIG. 5.

With reference now to FIGS. 9, 10 and 11, clamp 16 shown in another of its forms has its section 16B modified so as to carry slots 16C and 16D at opposite ends thereof. As shown in FIG. 5, when track 17 on clamp section 16A engages rail 14 as aforenoted, slots 16C and 16D on clamp section 16B, which fits into and is captured within space 20 as aforenoted, receive bolts 32. Bolts 32 will be recognized as part of coupling arrangement 28 as in conventional toilets 8.

It will thus be seen with reference to FIGS. 5, 9, 10 and 11 that the arrangement of slots 16C and 16D on clamp section 16B is effective to clamp raised seat 2 in a superimposed position on toilet 8 in a somewhat more secure fashion than that described with reference to FIGS. 4, 6, 7 and 8, as may be desired in some cases.

In accordance with the aforegoing description of the invention, a raised superimposed toilet seat and securing clamp have been provided in combination, whereby the raised seat is superimposed on the bowl of a conventional toilet with the seat and the lid of the conventional toilet in a raised position against the water tank. The clamp is in cooperative relation with the raised superimposed seat and the toilet so as to firmly secure said seat in a superimposed position on the conventional toilet.

The arrangement described maximizes user comfort and stability and thus enhances the use of raised superimposed toilet seats by elderly persons and others who suffer immobilizing infirmaties to the extent that they are unable to use conventional toilet seats. The aforenoted clamping precludes movement of the raised superimposed toilet seat as might otherwise occur upon a user lowering or lifting the body relative to the raised seat.

With the aforegoing description of the invention in mind, reference is had to the appended claims which define the scope of the invention.

What is claimed is:

1. For use with a toilet of the type having a bowl, seat means, means coupling the seat means to the toilet so that the seat means can be lifted relative to the bowl, with a space being provided between the coupling means and the toilet when said seat means is lifted, in combination, a raised seat superimposed on the toilet and a clamp for securing said raised superimposed seat to the toilet, characterized by:

the raised seat including an upper portion which rests on the bowl, a lower portion which fits into the bowl and having a back which carries a rail;

the clamp including a first section which carries a track and a second section extending rearwardly from the first section;

the second section being received in the space between the coupling means and the toilet so as to be captured therein, and the track of the first section engaging in sliding fit relation with the rail on the back of the raised seat; and the first and second sections of the clamp thereby being in cooperative relation with the raised superimposed seat and the toilet, respectively, to secure said seat to said toilet.

2. The combination described by claim 1, characterized by:

the rail having a base which is integral with the back of the raised seat and a pair of arms extending in opposite directions beyond the base;

the track on the first section of the clamp having a pair of recesses at each of its ends; and the rail arms being received in corresponding track recesses so that the rail is captured within the track when said track engages said rail in sliding fit relation.

3. The combination described by claim 1, characterized by:

the clamp being oriented so that the track on the first section thereof is substantially vertical for engaging the rail which extends substantially vertical on the back of the raised seat; and the second section of the clamp extends rearwardly from the first section and slightly downward from the perpendicular for being received in the space between the coupling means and the toilet so as to be captured therein.

4. The combination described by claim 1, characterized by:

the means coupling the seat means to the toilet including a pair of bolts in spaced relation;

the second section of the clamp including a pair of slots in corresponding spaced relation; and the bolts being received in the slots when said second section of the clamp is received in the space between the coupling means and the toilet so as to be captured therein.

5. For use with a toilet of the type having a bowl, seat means, means coupling the seat means to the toilet so that the seat means can be lifted relative to the bowl, with a space being provided between the coupling means and the toilet when said seat means is lifted, in combination, a raised seat superimposed on the toilet and a clamp for securing said raised superimposed seat to the toilet, characterized by:

the raised seat including an upper portion which rests on the bowl, a lower portion which fits into the bowl and a back which has a first member integral therewith;

the clamp including a first section which carries a second member integral therewith and a second section extending rearwardly from the first section; and the second section being received in the space between the coupling means and the toilet so as to be captured therein and the second member integral with the first section of the clamp engaging the first member integral with the back of the raised seat whereby the first and second sections of the clamp are in cooperative relation with the raised superimposed seat and the toilet, respectively, to secure said seat to said toilet.

6. The combination described by claim 5, characterized by:

the first member integral with the back of the raised seat being a rail;

the second member integral with the first section of the clamp being a track; and the rail engaging the track whereby the first section of the clamp is in cooperative relation with the raised superimposed toilet seat.

7. The combination described by claim 6, characterized by:

the rail integral with the back of the seat extending substantially vertical; and the clamp being oriented so that the track integral with the first section of the clamp is substantially vertical for engagement of the rail and track.

8. The combination described by claim 5, characterized by:

the second section of the clamp extending rearwardly and slightly obtuse from the first section thereof for being received in the space between the coupling means and the toilet so as to be captured therein, whereby the second section is in cooperative relation with the toilet.

9. The combination described by claim 8, characterized by:

the means coupling the seat means to the toilet including a pair of bolts in spaced relation;

the second section of the clamp extending rearwardly and slightly obtuse from the first section including a pair of slots in corresponding spaced relation; and the bolts being received in the slots when said second section of the clamp is received in the space between the coupling means and the toilet so as to be captured therein.

* * * * *